US006788795B2

(12) United States Patent
Scheeper et al.

(10) Patent No.: US 6,788,795 B2
(45) Date of Patent: Sep. 7, 2004

(54) MICROMACHINED CAPACITIVE COMPONENT WITH HIGH STABILITY

(75) Inventors: Patrick Richard Scheeper, Naerum (DK); Torben Storgaard-Larsen, Humlebaek (DK)

(73) Assignee: Brüel & Kjaer Sound & Vibration Measurement A/S, Naerum (DK)

( * ) Notice: Subject to any disclaimer, the term of this patent is extended or adjusted under 35 U.S.C. 154(b) by 32 days.

(21) Appl. No.: 10/195,461

(22) Filed: Jul. 16, 2002

(65) Prior Publication Data

US 2003/0021432 A1 Jan. 30, 2003

Related U.S. Application Data

(63) Continuation-in-part of application No. PCT/DK00/00731, filed on Dec. 22, 2000.

(51) Int. Cl.[7] ..... H04R 25/00
(52) U.S. Cl. ..... 381/174; 381/191
(58) Field of Search ..... 381/113, 116, 381/174, 190, 191; 367/140, 170, 181; 29/25.41, 594

(56) References Cited

U.S. PATENT DOCUMENTS

| | | | | |
|---|---|---|---|---|
| RE33,718 E | * | 10/1991 | Carlson et al. | 367/181 |
| 5,369,544 A | | 11/1994 | Mastrangelo | |
| 5,452,268 A | | 9/1995 | Bernstein | |
| 5,573,679 A | | 11/1996 | Mitchell et al. | |
| 5,677,965 A | | 10/1997 | Moret et al. | |
| 6,088,463 A | | 7/2000 | Rombach et al. | |
| 6,178,249 B1 | | 1/2001 | Hietanen et al. | |

FOREIGN PATENT DOCUMENTS

| | | |
|---|---|---|
| FI | 105880 B | 12/1999 |
| WO | WO 00/70630 | 11/2000 |
| WO | WO 02/052893 A1 | 7/2002 |

OTHER PUBLICATIONS

Scheeper et al., "The Design, Fabrication, and Testing of Corrugated Silicon Nitride Diaphragms", Journal of Microelectromechanical Systems, vol. 3, No. 1, pp. 36–42, Mar., 1994.

Kabir et al., "High sensitivity acoustic transducers with thin p+ membranes and gold back–plate", Sensors and Actuators 78, pp. 138–142, 1999.

Kühnel et al., "A silicon condenser microphone with structured back plate and silicon nitride membrane", Sensors and Actuators A. 30, pp. 251–258, 1992.

Pedersen et al., "An integrated silicon capacitive microphone with frequency–modulated digital output", Sensors and Actuators A 69, pp. 267–275, 1988.

Bergqvist et al., "A silicon condenser microphone using bond and etch–back technology", Sensors and Actuators A 45, pp. 115–124, 1994.

(List continued on next page.)

*Primary Examiner*—Huyen Le
(74) *Attorney, Agent, or Firm*—Oliff & Berridge, PLC

(57) ABSTRACT

A micromachined component such as a transducer having a support structure with a rigid plate secured to the surface of the support structure by means of support arms directly interconnecting the rigid plate and the support structure at discrete locations. A diaphragm of a substantially non-conductive material is secured to the support structure along its periphery at a predetermined distance from the rigid plate. The rigid plate has a surface facing the air gap carrying an electrically conductive surface portion on that surface, and the diaphragm has a surface facing the air gap carrying an electrically conductive surface portion on that surface. For each support arm, at least one of the electrically conductive surface portions is separated from the support arm at a distance along the surface carrying the respective electrically conductive surface portion. This construction ensures a high leakage resistance and a low parasitic capacitance.

16 Claims, 3 Drawing Sheets

OTHER PUBLICATIONS

Torkkeli et al., "Capacitive microphone with low–stress polysilicon membrane and high–stress polysilicon backplate", Sensors and Actuators 85, pp. 116–123, 2000.

Bourouina et al., "A new condenser microphone with a $p^+$silicon membrane", Sensors and Actuators A. 31, pp. 149–152, 1992.

Horwath et al., "Miniature Condenser Microphone With A Thin Silicon Membrane Fabricated On Simox Substrate", The $8^{th}$ International Conference on Solid–State Sensors and Actuators, and Eurosensors IX, Transducers '95 Eurosensors IX, pp. 696–699, Jun., 1995.

Scheeper et al., "Fabrication of Silicon Condenser Microphones using Single Wafer Technology", Journal of Microelectromechanical Systems, vol. 1, No. 3, pp. 147–154, Sep., 1992.

Hohm et al., "A subminiature condenser microphone with silicon nitride membrane and silicon back plate", Journal of the Acoustical Society of America, pp. 476–480, Jan., 1989.

Frederiksen, "Reduction of Non–linear Distortion in Condenser Microphones by Using Negative Load Capacitance", B&K Technical Review, No. 1, pp. 19–31, 1996.

* cited by examiner

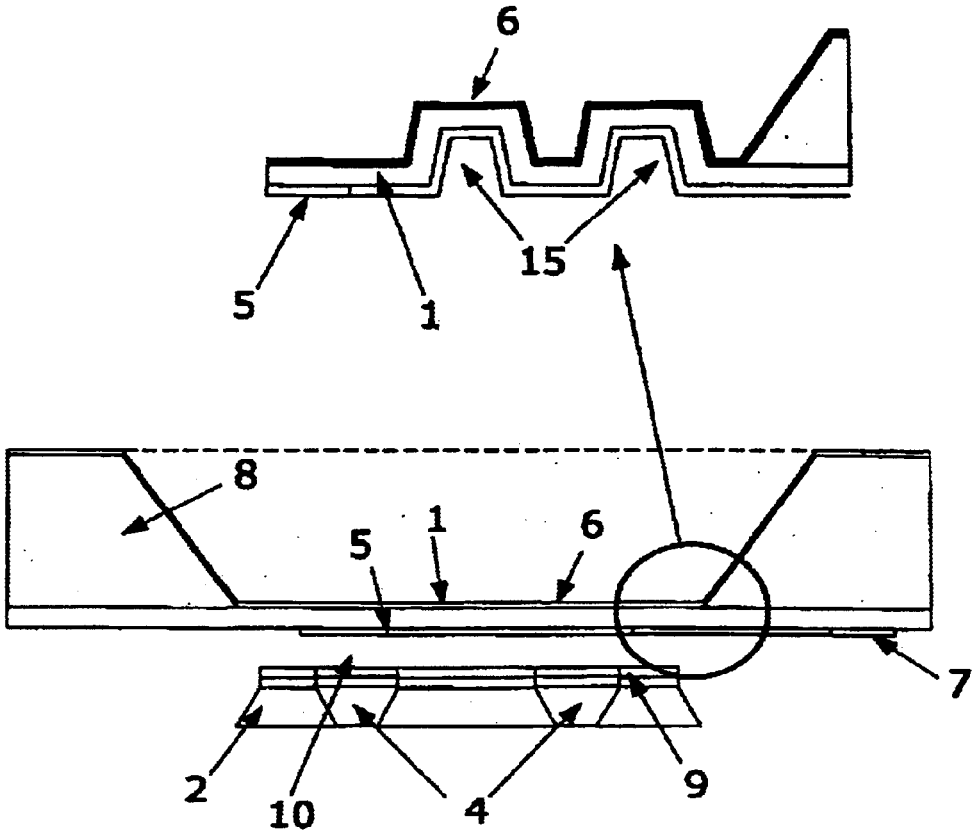
FIG. 7 cross section and detail

MICROMACHINED CAPACITIVE COMPONENT WITH HIGH STABILITY

This is a Continuation-in-Part of International Application No. PCT/DK00/00731 filed Dec. 22, 2000. The entire disclosure of the prior application is hereby incorporated by reference herein in its entirety.

This invention relates to a micromachined capacitive electrical component in general. In particular the invention relates to a capacitive transducer such as a condenser microphone. Such micromachined components or systems are often referred to as Micro Electro-Mechanical Systems (MEMS).

BACKGROUND OF THE INVENTION

A capacitive transducer such as a condenser microphone typically has a thin diaphragm that is arranged in close proximity to a back plate defining an air gap therebetween. The thin diaphragm is constrained at its edges, so that it is able to deflect when sound pressure is acting on it. Together the diaphragm and back plate form an electric capacitor, where the capacitance changes when sound pressure deflects the diaphragm. In use, the capacitor will be electrically charged using a DC bias voltage. When the capacitance of the microphone varies due to a varying sound pressure, an AC voltage proportional to the sound pressure will be superimposed on the DC voltage. The AC voltage is used as output signal of the microphone.

The sensitivity of the microphone, ie the ratio of the output AC voltage to the input sound pressure acting on the microphone, increases with the applied DC bias voltage. Consequently, in order to obtain a highly stable sensitivity without drift in time, the DC voltage across the air gap between the diaphragm and the back plate must be very stable. Note that a highly stable sensitivity is a requirement for any critical application of microphones, such as for example microphones for sound level measurement or other technical or scientific purpose.

The DC voltage is applied from an external voltage source via a bias resistor. The bias resistance must be so high that it ensures a virtually constant charge on the microphone, even when the capacitance changes due to sound pressure acting on the diaphragm. The value of this bias resistor is typically 1 to 10 GΩ. When the leakage resistance of the microphone is infinitely high, the voltage across the microphone equals the applied DC voltage. If however, the leakage resistance of the microphone is not infinitely high, the applied DC voltage is divided between the bias resistor and the leakage resistance of the microphone, and consequently, the sensitivity of the microphone decreases. Therefore, a usual and practical requirement for a highly stable microphone is that the leakage resistance must be at least 1000 times higher than the resistance of the bias resistor, even under severe environmental conditions, as for instance in conditions of high humidity and high temperature.

Another cause of a change in the voltage across the air gap between the diaphragm and the back plate is the presence of additional charges in the air gap, ie charges not related to an applied polarization voltage. This behavior is well known, and utilized in electret microphones, where an electric charge is intentionally stored in an insulator layer in the air gap, so an electrical field is present in the air gap of the microphone without the need for an external voltage supply. However, in condenser microphones that are polarized by an external voltage source, charge storage is undesirable, since it changes the DC voltage across the air gap, thus causing changes in sensitivity. Storage of charge in the air gap of the microphone requires the presence of an insulating layer in the air gap. So in a highly stable condenser microphone the presence of insulating layers between the diaphragm electrode and the back plate electrode is undesirable.

Summarizing, the construction of a condenser microphone with a highly stable sensitivity over time, requires:

1. A leakage resistance that is at least 1000 times the bias resistor value, even under severe environmental conditions
2. No insulating layers in the air gap between the diaphragm electrode and the back plate electrode From traditional measurement condenser microphones for industrial and scientific purposes it is known that the leakage resistance is determined by the leakage current across the surface of an insulator disc that separates the electrical contacts of the connector of the microphone. Likewise, in micromachined condenser microphones, the leakage resistance is determined by leakage current across the surface of the insulating material that separates the diaphragm electrode and the back plate electrode. The leakage resistance increases if the shortest distance that the leakage current has to travel across the insulator is increased. In traditional measurement condenser microphones, the shortest distance is of the order of millimeters. In some of the micromachined condenser microphones that are presented in literature, the shortest distance comes down to the thickness of an insulator layer that is of the order of 1 μm! This is for example the case in designs, where both the back plate and the diaphragm are made of monocrystalline or polycrystalline silicon, where a silicon dioxide spacer layer with a thickness between 1 and 3 μm has to provide the electrical insulation between diaphragm and back plate. Examples of such constructions are presented in the publication entitled "A silicon condenser microphone using bond and etch-back technology" by J. Bergqvist and F. Rudolf in the journal Sensors and Actuator A, 45 (1994) 115–124, and "Capacitive microphone with low-stress polysilicon membrane and high-stress polysilicon back plate" by A. Torkkeli et al. in the journal Sensors and Actuator, 85 (2000) 116–123 (corresponding to U.S. Pat. No. 6,178,249, Hietanen et al.), and in U.S. Pat. No. 5,452,268 "Acoustic transducer with improved low frequency response". That type of construction cannot be expected to have a leakage resistance that is at least 1000 times the bias resistor value, especially under conditions of high humidity and temperature. Consequently, that type of microphone would be suitable only for uncritical low-end applications, but is definitely not suited for any critical application that requires the sensitivity to be stable over time.

Another microphone construction that may ensure a high leakage resistance between the diaphragm electrode and the back plate electrode is presented in the publication "A new condenser microphone with a $p^+$ silicon membrane", by T. Bourouina et al. in the journal Sensors and Actuators A, 31 (1992) 149–152. That microphone is made by bonding a silicon part, containing an etched diaphragm, onto a glass substrate, that contains the back plate electrode. The shortest distance between the diaphragm electrode and the back plate electrode is now considerably larger than the air gap thickness, so a higher leakage resistance can be expected. However, a disadvantage of using chips made of bonded silicon- and glass substrates is the thermal mismatch between the two materials. Although glass types exist (e.g. Pyrex 7740) that are developed with the purpose of providing properties matching those of silicon, they never exactly match the thermal expansion coefficient over the complete operating range of the transducer (typically −30° C. to +150° C.). The difference in thermal expansion coefficient causes a thermal stress in the diaphragm, which gives increased temperature sensitivity. Another effect is thermal bending of the silicon-glass sandwich (like a bimetal, since the silicon and glass have a comparable thickness) that gives a temperature-dependent change in air gap thickness that also gives a change in sensitivity. Therefore, microphone chips made by bonding silicon to glass suffer from temperature drift of the sensitivity, which is undesirable in critical applications of microphones.

Microphone chip designs based on an insulating diaphragm material are often to be preferred from a fabrication point-of-view. There are several electrically conducting diaphragm materials that can be made on silicon wafers. In the table below, a list of conducting diaphragm materials is shown, together with the disadvantages.

| | |
|---|---|
| Evaporated or sputtered metal | Lack of stress control<br>Need for complicated layer protection during silicon etching |
| $p^{++}$ silicon (boron etch-stop) | Lack of stress control |
| $p^{+}$ silicon (pn etch-stop) | Lack of stress control<br>Complicated etching process |
| Polycrystalline silicon | Need for complicated layer protection during silicon etching |

With most of the conductive diaphragm materials, the stress cannot be controlled, whereas this is an extremely important parameter to control, microphone parameters such as sensitivity and resonance frequency. The stress of polycrystalline silicon can be controlled with sufficient accuracy, but the fabrication of microphone diaphragms is complicated, since the thin diaphragms have to be protected during etching of the silicon wafer. A very attractive insulating diaphragm material is silicon nitride. The stress of the silicon nitride layers can be accurately controlled, and the fabrication of diaphragms is relatively easy, since silicon nitride is hardly attacked by the silicon etchant. Therefore, we consider silicon nitride to be a better diaphragm material than the available conducting materials. Other suitable diaphragm materials are silicon oxynitride, and multi-layer diaphragm comprising two or more layers of silicon dioxide, silicon oxynitride or silicon nitride, respectively.

To obtain favorable mechanical properties of the diaphragm, insulating materials are often used as diaphragm material in micromachined condenser microphones. As a consequence, the diaphragm has to be provided with an extra metal layer, preferably on its surface or possibly as an intermediate layer. For technological reasons, this metallization is often done as a final step in the fabrication process, causing the metal layer to be on the outside of the microphone, and the insulating diaphragm material to be located between the diaphragm electrode and the back plate electrode. Examples of such microphones are found in the publications "Miniature condenser microphone with a thin silicon membrane fabricated on SIMOX substrate" by P. Horwath et al. (Proc. Transducers '95, Stockholm, Sweden, Jun. 25–29, 1995, pp. 696–699), "An integrated silicon capacitive microphone with frequency-modulated digital output" by M. Pedersen et al. (Sensors and Actuators A, 69 (1998) 267–275), "Fabrication of silicon condenser microphones using single-wafer technology" by P. R. Scheeper et al. (IEEE Journal of MEMS, 1 (1992) 147–154). An advantage of having an insulating layer between the diaphragm electrode and the back plate electrode is a high leakage resistance between the electrodes, since a leakage current has to travel through the insulator layer. However, our own experience with micromachined microphones with an insulating layer between the diaphragm electrode and the back plate electrode is that these microphones show a serious drift of sensitivity in time, irreproducible sensitivity due to an uncontrolled amount of charge in the insulator arising during fabrication, assembly, and use, and hysteresis in sensitivity and capacitance when switching between zero DC bias and normal DC polarization voltage. Therefore, we believe that micromachined microphones with an insulating layer between the diaphragm electrode and the back plate electrode are not suitable for critical applications that require a stable sensitivity over time.

The article "A subminiature condenser microphone with silicon nitride membrane and silicon back plate" by Hohm and Hess in 1989 (J. Acoust. Soc. Am., 85 (1989) 476–480) discloses a microphone chip with a silicon nitride diaphragm that is metallized with evaporated aluminium, and where the aluminium electrode is inside the air gap. The back plate chip consists of an oxidized silicon wafer provided with an aluminium electrode. A microphone is assembled by putting together a diaphragm chip and a back plate chip. Since both the diaphragm and back plate electrodes are placed inside the air gap, there are no insulators present between them. The publication also shows a photograph of the back plate wafer, showing that the minimum distance between the electrodes is about 100 $\mu$m. The microphone design of Hohm and Hess fulfills two important requirements for making microphones with a highly stable sensitivity. However, a disadvantage of the design that is presented by the authors, is the high on-chip parasitic capacitance, causing the microphone signal to be divided by a factor of 4.3, corresponding to a loss of sensitivity of nearly 13 dB. This loss of sensitivity gives a decreased signal-to-noise ratio, and can therefore not be compensated by simply amplifying the microphone's output signal. Another disadvantage of the large on-chip parasitic capacitance is that the harmonic distortion of a condenser microphone increases with the parasitic capacitance, as demonstrated in the publication "Reduction of non-linear distortion in condenser microphones by using negative load capacitance" by E. Frederiksen in B&K Technical Review no. 1 (1996) 19–31. Therefore, a microphone design with a high on-chip parasitic capacitance will show a poor performance, which makes it useless for any demanding application. It is therefore desirable to have a low on-chip parasitic capacitance.

The relatively large contact area between the metallized diaphragm chip and the back plate chip causes the parasitic capacitance in the design of Hohm and Hess. Reducing the parasitic capacitance in that design is thus a matter of reducing the area of one of the adjacent chip surfaces. Reducing the area of the diaphragm chip implies that the silicon frame that surrounds the diaphragm is weakened considerably, which is undesirable. Besides, a photograph of the assembled transducer in the publication of Hohm and Hess shows that the silicon frame of the tested microphones can hardly be made smaller. Reducing the area of the back plate chip is only possible using a back plate layout that is totally different from the design of Hohm and Hess. The fabrication of the microphone of the invention is not possible with the fabrication process that is described by Hohm and Hess. Therefore, we propose a new design that results in microphones with a stable sensitivity, and that overcomes the problems with on-chip parasitic capacitance.

Another disadvantage of the Hohm and Hess microphone is that the aluminium electrodes tend to oxidize, and oxides are capable of retaining charges that add to the charges created by the polarization voltage, whereby the sensitivity changes proportionally. It is therefore desirable to avoid oxidizing materials between the diaphragm electrode and the back plate electrode.

Much of what is stated above in relation to condenser microphones also applies to capacitive electrical components in general and to MEMS components in particular.

OBJECTS OF THE INVENTION

The object of the invention is to provide a micromachined capacitive electrical component and in particular a condenser microphone, which meets at least one of the following requirements and preferably all three:

1. A very high leakage resistance between the diaphragm electrode and the back plate electrode, 2. Storage or accumulation of electrical charges in the air gap should be avoided, and 3. A low on-chip parasitic capacitance to avoid loss of sensitivity and to keep harmonic distortion low.

BRIEF DESCRIPTION OF THE DRAWINGS

FIG. 7 is a cross-sectional view, as in FIG. 2, with an enlarged detail of the diaphragm, showing the optional corrugated edge of the diaphragm.

DETAILED DESCRIPTION OF THE INVENTION

Figure 1:
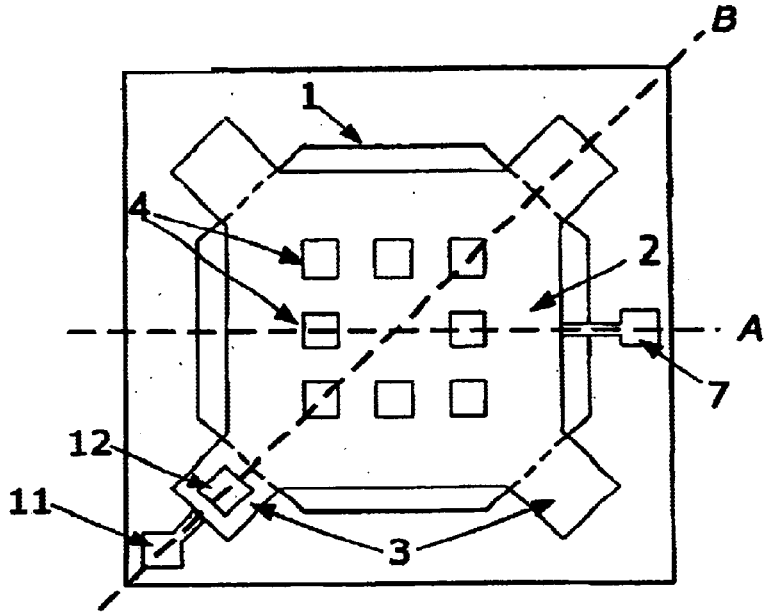
FIG. 1 is a schematic top view of a microphone chip according to the invention.
Figure 2:
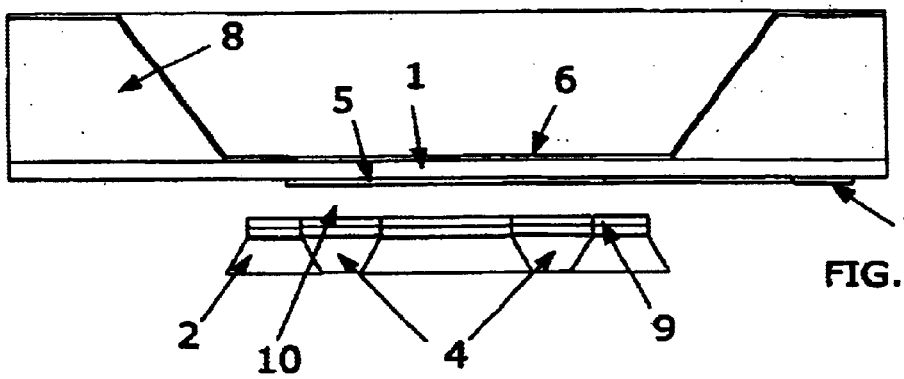
FIG. 2 is a cross-sectional view along line A—A in FIG. 1.
Figure 3:
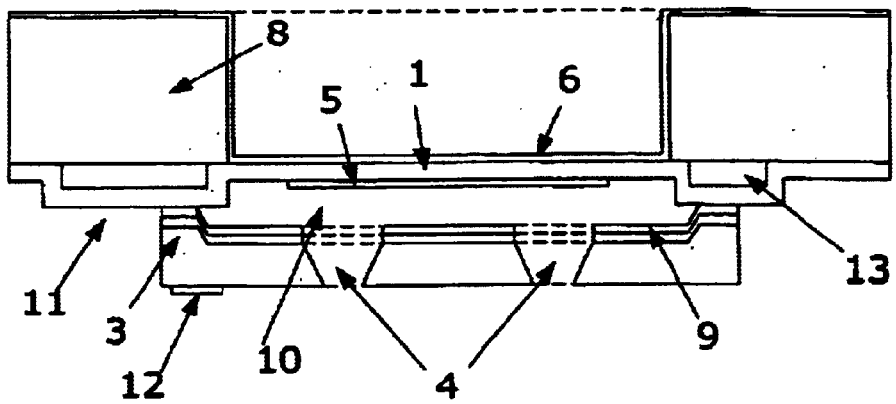
FIG. 3 is a cross-sectional view along line B—B in FIG. 1.
Figure 4:
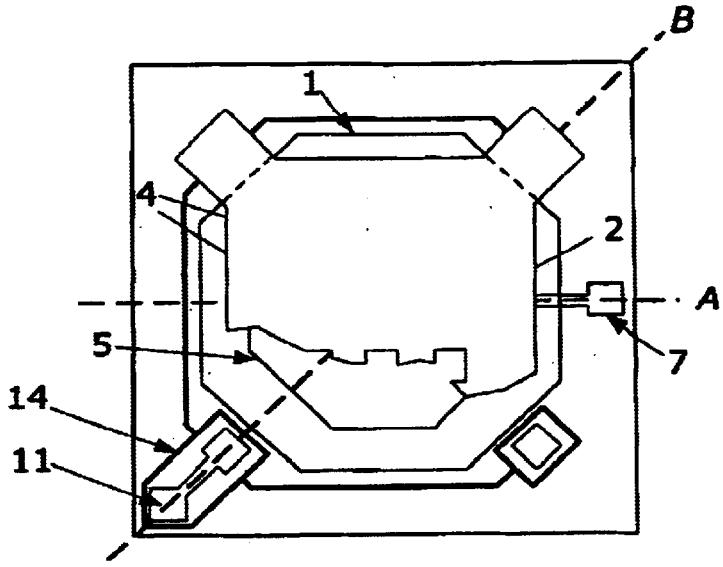
FIG. 4 is a schematic top view of a microphone chip according to the invention, provided with an optional guard ring construction
Figure 5:
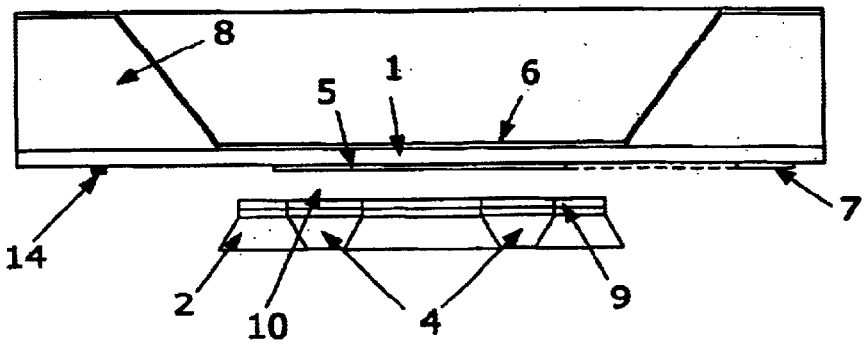
FIG. 5 is a cross-sectional view along line A, as indicated in FIG. 4.
Figure 6:
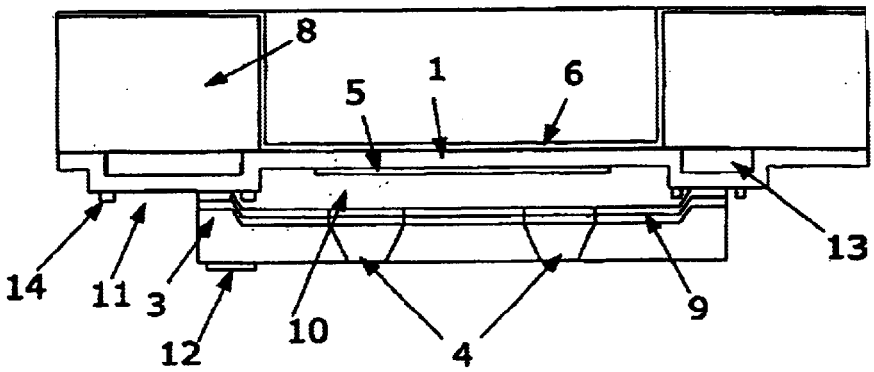
FIG. 6 is a cross-sectional view along line B, as indicated in FIG. 4.

The invention will be described with a MEMS condenser microphone as an illustrative example, but the same principles of construction apply to capacitive MEMS components in general.FIG. 1 shows a diaphragm 1 with its perimeter. In this example it is drawn as an octagon, but is can be square as well, or have any other shape as a result of the used fabrication technique, or the intentions of the designer. The back plate 2 is secured to the chip by four arms or finger-like supports 3 at discrete locations rather than along a path encircling the diaphragm as in Hohm and Hess. It should be noted that, depending on technological requirements and desired properties of the microphone, the designer can vary the positioning of the supports and the number of supports. The finger like supports 3 at discrete locations serve to reduce the contact area between the back plate 2 and the chip to only a fraction of the contact area of Hohm and Hess, whereby the on-chip parasitic capacitance is proportionally reduced, and the bulk leakage resistance is proportionally increased.The back plate is provided with a plurality of holes 4 that are used to control the damping of the diaphragm that is caused by flow of the air as a result of the movements of the diaphragm in response to sound pressure acting on the diaphragm. In this example there are drawn eight holes, but the designer can choose any number. The number, size and distribution of the holes can be varied for "tuning" the damping of the diaphragm in order to get the desired frequency response of the microphone. Furthermore, three bond pads 7 and 11 and 12 are shown, that provide electrical contact or terminals of the diaphragm and back plate electrode, and silicon back plate, respectively.FIG. 2 shows a schematic cross-sectional view of the microphone along line A—A in FIG. 1. The diaphragm 1 is provided with an electrode 5 on its side facing the air gap, and with an electrode 6 on the other side of the diaphragm. The diaphragm is typically made from silicon nitride or other insulating material. The electrodes 5 and 6 are typically made from gold, but can in principle be any metal or other electrically conductive substance. A bond pad 7 provides electrical access to the electrode 5. A chip frame 8 supports the diaphragm 1. The back plate 2 is typically made of silicon, but can be made of other materials as well, such as a metal or glass. The holes 4 in the back plate are seen. The back plate 2 is provided with an electrode 9 on its side facing the air gap. The electrodes 5, 6 and 9 can in principle be any metal or other electrically conductive substance, but non-oxidizing conducting materials such as gold are preferred. The diaphragm electrode 5 and back plate electrode 9 define an air gap 10.FIG. 3 shows a schematic cross-sectional view of the microphone along line B—B. Besides the items that are already indicated using the same numbers in FIG. 2, FIG. 3 shows the supports that connect the back plate 2 to the chip with the diaphragm. The electrical connection to the back plate electrode 9 is obtained through the bond pad 11. In this figure, an optional insulator layer 13 is shown, that further reduces the parasitic capacitance between the back plate electrode 9 and the bond pad 11, and the silicon chip frame 8.In the regions near the finger-like support arms 3 the periphery of the inner diaphragm electrode 5 is at a distance from the support arms 3, whereby the surface leakage resistance between the inner diaphragm electrode 5 and the back plate electrode 9 is increased. Alternatively or additionally, and for the same purpose, the periphery of the back plate electrode 9 can be at a distance from the support arms 3.The contact 12 to the silicon back plate 2 can be used to control the electrical potential of the silicon, since the silicon may often be electrically insulated from the back plate electrode 9. This can be done for a number of reasons, for example to avoid the formation of metal silicides due to direct contact between metal and silicon. However, in another embodiment of the invention, there may be direct contact between the silicon and a metal, if an appropriate metal, or combination of metals, is found. Another embodiment of the invention has a back plate, comprising metal only, for example formed by electrochemical deposition in a bath containing a metal salt solution.The second electrode 6 on the outer surface of the diaphragm provides shielding against electromagnetic interference (EMI) and is at the same potential as the diaphragm electrode 5.In FIG. 3 it can be seen that a part of the back plate electrode 9 still faces an insulator. This is the part of the silicon nitride diaphragm, which is underneath the supports 3 of the back plate. However, in a practical design this is only a small fraction of the total back plate electrode area, and no problem has been observed in stability tests performed with the microphones.In FIGS. 4, 5, and 6 another embodiment of the invention is shown, where the microphone is provided with a guard ring. FIG. 4 shows a top view of the chip, where a part of the back plate 2 is hidden, to show the guard ring 14. The guard ring 14 is positioned between diaphragm electrode 5 and the corresponding bond pad 7, and the back plate electrode 9. The guard ring is driven at the same potential as back plate electrode 9 and is used to further increase the leakage resistance between diaphragm electrode 5 and back plate electrode 9. This can be desirable in extremely critical situations, with for example condensation of water on the chip surface. The guard ring 14 is also indicated in the chip cross-sectional views in Fig. 5 and Fig. 6.In FIG. 7 another embodiment of the invention is shown, where the microphone diaphragm is provided with corrugations giving added flexibility. The corrugations are only indicated in the part of FIG. 7 that shows a detailed view of the edge of the diaphragm. The effect of corrugations 15 is that the stress in the diaphragm is reduced in a controlled way, so that the sensitivity of a diaphragm to sound pressure is increased. A detailed description of the effect of corrugations in microphone diaphragms can be found in the publication entitled "The design, fabrication, and testing of corrugated silicon nitride diaphragms" by P. R. Scheeper et al. in IEEE Journal of Microelectro-mechanical Systems, 3 (1994) pp. 36–42. Although FIG. 7 only shows a diaphragm with two corrugations close to its perimeter, it is obvious to those skilled in the art that there can be more corrugations, and that the complete diaphragm can be corrugated, so there no longer is a flat zone in the center of the diaphragm.The described microphone is primarily intended for scientific and industrial acoustic precision measurements, ie the typical frequency range from 10 Hz to 40 kHz. It will be obvious to those skilled in the art that by extending the frequency range to ultrasonic frequencies (>40 kHz) the invention has the same advantages over prior art, as discussed above. The same applies to extending the frequency range to lower frequencies, ie <10 Hz, and ultimately down to 0 Hz, so the microphone becomes a static pressure transducer.The new microphone design has superior performance, referring to the three requirements:

1. Through a proper mask layout the shortest surface distance between diaphragm electrode 5 and back plate electrode 9 can be made as long as desired to provide a high surface leakage resistance. Measurements have shown that with the invention the silicon nitride surface can maintain a resistance of more than $10^{14}\Omega$, even under humid conditions.
2. There are no insulating layers in the air gap 10 between the diaphragm electrode 5 and the back plate electrode 9.
3. The on-chip parasitic capacitance in the proposed design determined by the contact area of the localized back plate supports 3 and the area of the bond pad 11. In the new microphone design proposed, the parasitic capacitance can be reduced to considerably lower values than in the design of Hohm and Hess.

Since all these three requirements have been fulfilled, the microphone design of the invention shows a superior stability and sensitivity as compared to prior art discussed above.The MEMS condenser microphone as shown and described will preferably be mounted in a suitable housing with proper electrical connections and with 20 physical protection, which is known in the art and therefore is not part of the invention.The MEMS condenser microphone as shown and described can also be used as a capacitive electrical component in general, where its properties as a transducer are of no importance, but where high stability is a requirement. In such case the chip may be encapsulated eg in a standard housing for electrical and electronic components that provides physical and electrical protection as well as electrical connections.

What is claimed is:1. A micromachined capacitive electrical component having a support structure with a surface, a rigid plate secured to the surface of the support structure by means of support arms directly interconnecting the rigid plate and the support structure at a plurality of discrete locations, a diaphragm having a layer of a substantially non-conductive material, the diaphragm having a periphery and being secured to the support structure along its periphery at a predetermined distance from the rigid plate, whereby the rigid plate and the diaphragm define an air gap therebetween, the rigid plate having a surface facing the air gap carrying an electrically conductive surface portion on the surface facing the air gap, and the diaphragm having a surface facing the air gap carrying an electrically conductive surface portion on the surface facing the air gap, where, for each support arm, at least one of the electrically conductive surface portions is separated from the corresponding discrete location by a distance along the surface carrying the respective electrically conductive surface portion.2. A component according to claim 1 wherein the diaphragm is movable in response to sound pressure, whereby the component is an electro-acoustical transducer.3. A transducer according to claim 2 wherein the support arms are non-conducting.4. A transducer according to claim 2, wherein the support structure, at least at the discrete locations, has a layer of an non-conduction material, to which the support arms are secured.5. A transducer according to claim 2, wherein the surface of the support structure has a guard electrode of a conducting material encircling the discrete locations.6. A transducer according to claim 2, wherein the rigid plate has one or more through-going holes.7. A transducer according to claim 2, wherein the diaphragm is made from silicon nitride, silicon oxynitride, silicon carbide or from a combination of two or more layers of silicon dioxide, silicon nitride, silicon oxynitride, silicon carbide or polycrystalline silicon.8. A transducer according to claim 2, wherein the rigid plate substantially comprises monocrystalline silicon or polycrystalline silicon.9. A transducer according to claim 8, characterized in that the rigid plate further includes one or more metal electrode layers.10. A transducer according to claim 9, characterized in that the rigid plate further includes a non-conductive layer.11. A transducer according to claim 2, wherein the rigid plate comprises one or more metals or alloys thereof.12. A transducer according to claim 2, wherein the rigid plate comprises a non-conductive material with an electrode comprising one or more metals or alloys thereof on the surface.13. A transducer according to claim 2, wherein the diaphragm is provided with corrugations.14. A component according to claim 1, wherein the diaphragm is provided with an electrically conducting surface portion on the surface facing away from the air gap.15. A component according to claim 1, wherein a layer of a substantially non-conductive material is disposed between the substantially rigid plate and the support structure at least at the discrete locations.16. A component according to claim 1, wherein the electrically conductive surface portion (5) on the surface of the diaphragm (1) facing the air gap (10), and the electrically conductive surface portion on the surface of the back plate (2) facing the air gap (10), are non-oxidizing.

* * * * *